US007800557B2

(12) United States Patent
Kim

(10) Patent No.: US 7,800,557 B2
(45) Date of Patent: Sep. 21, 2010

(54) ORGANIC ELECTROLUMINESCENT DISPLAY DEVICE AND DRIVING METHOD THEREOF

(75) Inventor: Yang-Wan Kim, Suwon-si (KR)

(73) Assignee: Samsung Mobile Display Co., Ltd., Suwon-si (KR)

( * ) Notice: Subject to any disclaimer, the term of this patent is extended or adjusted under 35 U.S.C. 154(b) by 708 days.

(21) Appl. No.: 11/697,802

(22) Filed: Apr. 9, 2007

(65) Prior Publication Data

US 2008/0111777 A1 May 15, 2008

(30) Foreign Application Priority Data

Nov. 9, 2006 (KR) ..... 10-2006-0110481

(51) Int. Cl.
*G09G 3/30* (2006.01)

(52) U.S. Cl. ..... 345/76; 345/82; 315/169.3

(58) Field of Classification Search ..... 345/82, 345/76, 83, 694, 695; 315/169.1, 169.3; 257/83, 84, E51.018; 445/24; 235/462.42; 313/500, 505; 349/143, 144
See application file for complete search history.

(56) References Cited

U.S. PATENT DOCUMENTS 7,202,881 B2 * 4/2007 Azami ..... 345/690
7,285,923 B2 * 10/2007 Yu ..... 315/307

FOREIGN PATENT DOCUMENTS

JP 02005319687 A * 11/2005
KR 2006-93142 8/2006
KR 10-786849 12/2007

* cited by examiner

*Primary Examiner*—Abbas I Abdulselam
(74) *Attorney, Agent, or Firm*—Stein McEwen, LLP

(57) ABSTRACT

An organic electroluminescent display device and the driving method thereof that can improve the aperture ratio. The organic electroluminescent display device according to the present invention includes first to third organic electroluminescent elements, first to third driving transistors to apply a driving current to the first to third organic electroluminescent elements, respectively, and first and second switches and a third switch group. A first light emission control line transfers a first light emission control signal, and a second light emission control line transfers a second light emission control signal. The first switch is turned on/off in response to the first light emission control signal, and the second switch and the third switch group are turned on/off in response to the first and second light emission control signals.

19 Claims, 3 Drawing Sheets

ORGANIC ELECTROLUMINESCENT DISPLAY DEVICE AND DRIVING METHOD THEREOF

CROSS-REFERENCE TO RELATED APPLICATIONS

This application claims the benefit of Korean Application No. 2006-110481, filed Nov. 9, 2006, in the Korean Intellectual Property Office, the disclosure of which is incorporated herein by reference.

BACKGROUND OF THE INVENTION

1. Field of the Invention

Aspects of the present invention relates to a light emitting display device and the driving method thereof, more particularly, to an organic electroluminescent display device that displays the emission of light from an organic material and a method for driving the same.

2. Description of the Related Art

Generally, an organic electroluminescent display device uses an organic electroluminescent element to display light emitted from an organic material. An organic electroluminescent display device drives N×M organic electroluminescent cells, which are arranged in a matrix form, with voltage or current to represent an image. Since an organic electroluminescent cell has the characteristics of a diode, it is also called an organic light emitting diode (hereinafter, referred to as OLED). An OLED has a structure consisting of an anode layer, an organic thin film layer, and a cathode layer.

In an organic electroluminescent display device, the area occupied by light emission control lines is relatively large because the light emission control lines are connected to each color pixel. Colors are displayed either spatially or temporally. When colors are displayed spatially, each pixel is divided into several subpixels each of which displays a unique color. The colors, when emitted, combine to represent the single color that a viewer observes. As such, every subpixel of the same color would require a connection to the light emission control line for that same color. Generally, a single pixel will be split into three subpixels to display red, green, and blue. Thus, each red, green, and blue subpixel is attached to a red, green, and blue light emission control line, respectively. Furthermore, each row of pixels may have its own red, green, and blue light emission control line. Accordingly, as the area of display units is limited, the many light emission control lines may decrease the aperture or decrease the area through which light may be displayed.

SUMMARY OF THE INVENTION

Aspects of the present invention provide an organic electroluminescent display device in which the aperture ratio is improved by reducing the number of light emission control lines, and a method for driving the organic electroluminescent display device.

Additional aspects and/or advantages of the invention will be set forth in part in the description which follows and, in part, will be obvious from the description, or may be learned by practice of the invention.

According to aspects of the present invention, there is provided an organic electroluminescent display device including a first organic electroluminescent element, a second organic electroluminescent element, a third organic electroluminescent element, first to third driving transistors to apply a driving current to the first to third electroluminescent elements, respectively, a first switch connected between a first electrode of the first organic electroluminescent element and a first electrode of the first driving transistor, a second switch connected between a first electrode of the second organic electroluminescent element and a first electrode of the second driving transistor, a third switch group connected between a first electrode of the third organic electroluminescent element and a first electrode of the third driving transistor, a first light emission control line to transfer a first light emission control signal, and a second light emission control line to transfer a second light emission control signal. The first switch is turned on/off in response to the first light emission control signal, the second switch is turned on/off in response to at least one of the first and second light emission control signals, and the third switch group is turned on/off in response to the first and second light emission control signals. The third switch group may include a third switch turned on/off in response to the first light emission control signal, and a fourth switch turned on/off in response to the second light emission control signal. The third switch may be connected between the first electrode of the third organic electroluminescent element and the first electrode of the third driving transistor, and the fourth switch may be connected between the first electrode of the third organic electroluminescent element and the first electrode of the third driving transistor. The first switch may be turned on when the first light emission control signal is at a first level, the second switch may be turned on when both the first and the second light emission control signal are at a second level, the third switch may be turned on when the first light emission control signal is at the first level, and the fourth switch is turned on when the second light emission control signal is at the second level. The first to third organic electroluminescent elements may correspond to first to third color subpixels, respectively.

According to another aspect of the present invention, there is provided a method for driving an organic electroluminescent display device that applies first to third driving currents transferred from first to third driving transistors, respectively, including a first operation of applying the first driving current to a first subpixel corresponding to the first driving transistor during a first period, a second operation of applying the second driving current to a second subpixel corresponding to the second driving transistor during a second period, and a third operation of applying the third driving current to a third subpixel corresponding to the third driving transistor during a third period. The third period overlaps the first period and the second period. The third period of the third operation may include a period of applying the third driving current in response to a first control signal, a period of applying the third driving current in response to the first control signal and a second control signal, and a period of applying the third driving current in response to the second control signal. The sum of the first and second periods may be equal to the third period.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
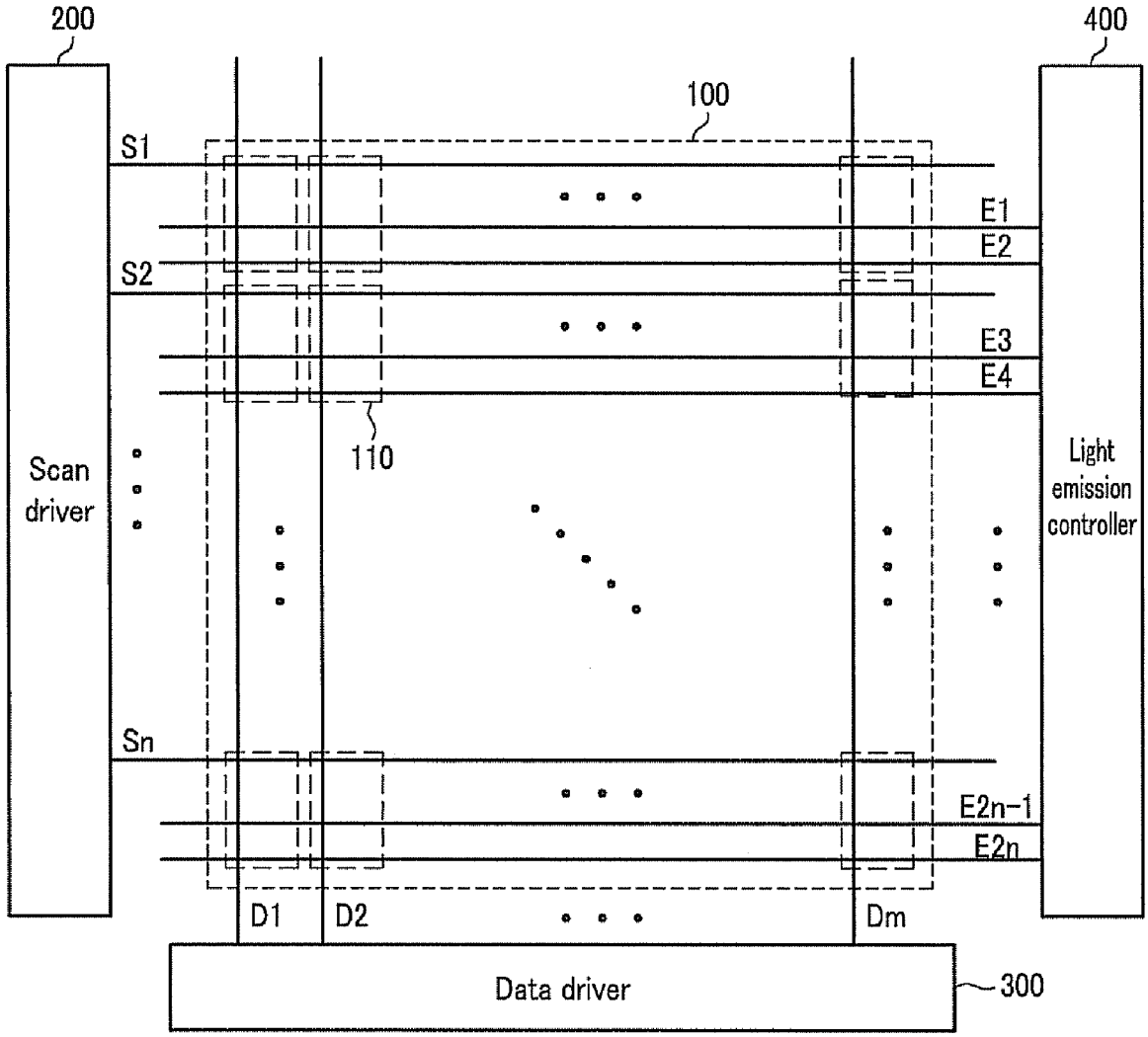
FIG. 1 is a schematic diagram of an organic electroluminescent display device according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 is a schematic diagram of an organic electroluminescent display device according to an embodiment of the present invention.

As shown in FIG. 1, the organic electroluminescent display device, according to aspects of the present invention, includes a display unit 100, a scan driver 200, a data driver 300, and a light emission controller 400.

The display unit 100 includes a plurality of scan lines S1-Sn, a plurality of data lines D1-Dm, a plurality of light emission control lines E1-E2*n*, and a plurality of pixels 110. Each of the plurality of scan lines S1-Sn extends in a row direction and transfers a selection signal to each of the pixels 110 in each corresponding row. Each of the plurality of data lines D1-Dm extends in a column direction and transfers a data signal to each of the pixels 110 in each corresponding column. Each of the plurality of light emission control lines E1-E2*n* extends in a row direction and transfers a light emission control signal to each of the pixels 110 in each corresponding row.

Each of the pixels 110 is formed on a pixel area that is defined by one of the plurality of scan lines S1-Sn, one of the plurality of light emission control lines E1-E2*n*, and one of the plurality of data lines D1-Dm. If the pixel 110 is a current programming type pixel, then the data signal is a current signal. If the pixel 110 is a voltage programming type pixel, then the data signal is a voltage potential.

In order to realize color in a display, each pixel 110 uniquely displays one primary color or alternatively displays the primary colors with time. When each pixel 110 uniquely displays one primary color, the color displayed is a spatial sum of the primary colors. When each pixel 110 cycles through colors with time, the color displayed is a temporal sum of the primary colors. The primary colors may be red (R), green (G), and blue (B). If a color is displayed by a temporal sum, the R, G, and B colors are displayed in turn on one pixel 110 to realize the desired color. If a color is displayed by a spatial sum, the color is represented by three individual pixels (not shown) within one pixel 110, which are the R pixel, the G pixel, and the B pixel. In this regard, each of the R pixels, the G pixels, and the B pixels may also be called subpixels. And, the three subpixels may be referred to as one pixel 110 as, per each frame, the three subpixels each produce a color to combine together with the colors produced by the adjacent subpixels in the pixel 110 to produce one color to display. Moreover, if a color is displayed by a spatial sum, the R, G, and B subpixels may be arranged in the row or column direction within the one pixel 110, or the three subpixels may be arranged at positions corresponding to three vertices of a triangle. The pixel 110 according to aspects of the present invention will be explained in the case in which the three subpixels are arranged in a row direction; however, the present invention is not limited thereto.

The scan driver 200 is connected to the scan lines S1-Sn of the display unit 100 to transfer to the scan lines S1-Sn a selection signal that is made of the combination of a gate-on voltage and a gate-off voltage. The scan driver 200 may transfer a selection signal so that each selection signal applied to the scan lines S1-Sn sequentially has a gate-on voltage. Also, if the selection signal has a gate-on voltage, a switching transistor connected to the corresponding scan line is turned on.

The data driver 300 is connected to the data lines D1-Dm of the display unit 100 to transfer a data signal representing a grayscale to the data lines D1-Dm. The data driver 300 converts the data signal representing a grayscale into a voltage or current data signal, depending upon the programming type of the pixel 110.

The light emission controller 400 is connected to light emission control lines E1-E2*n* of the display unit 100 to control the light emitting time of each pixel. A light emission control signal controls the light emitting time of the organic electroluminescent elements of the R, G, and B colors, which respectively correspond to the R, G, and B subpixels of each pixel 110. With respect to one pixel 110, the two light emission control lines that are connected to each pixel 110 are respectively connected to only two of the subpixels, or two of the R, G, and B organic electroluminescent elements, and one of the light emission control lines is connected to all three of the R, G, and B subpixels. Thus, one of the R, G, and B subpixels is connected to only one of the light emission control lines. Or put another way, one of the two light emission control lines connected to each pixel 110 is connected to all three subpixels while the other of the two light emission control lines connected to each pixel 110 is only connected to two of the subpixels. Or, one of the R, G, and B subpixels is controlled by only one of the light emission control lines; another of the R, G, and B subpixels is controlled by at least one of the light emission control lines; and, the last of the R, G, and B subpixels is controlled by both of the light emission control lines. Then, the light emitting time of the three subpixels can be controlled by only two light emission control signals.

More specifically, for example, a first light emission control line E1 might control the light emission of the red R subpixel of the pixel 110; and, both the first light emission control line E1 and a second light emission control line E2 acting together might control the light emission for the green G subpixel of the pixel 110; and the first and the second emission control lines E1 and E2 may independently control the light emission of the blue B subpixel of the pixel 110. As such, the R, G, and B subpixels only require two of the light emission control lines E1-E2*n* as opposed to each of the R, G, and B subpixels requiring individual light emission control lines.

A pixel circuit of the organic electroluminescent display device according to aspects of the present invention will now be described with reference to FIG. 2, and a method for controlling the light emitting time will be described in detail with reference to FIG. 3.

Figure 2:
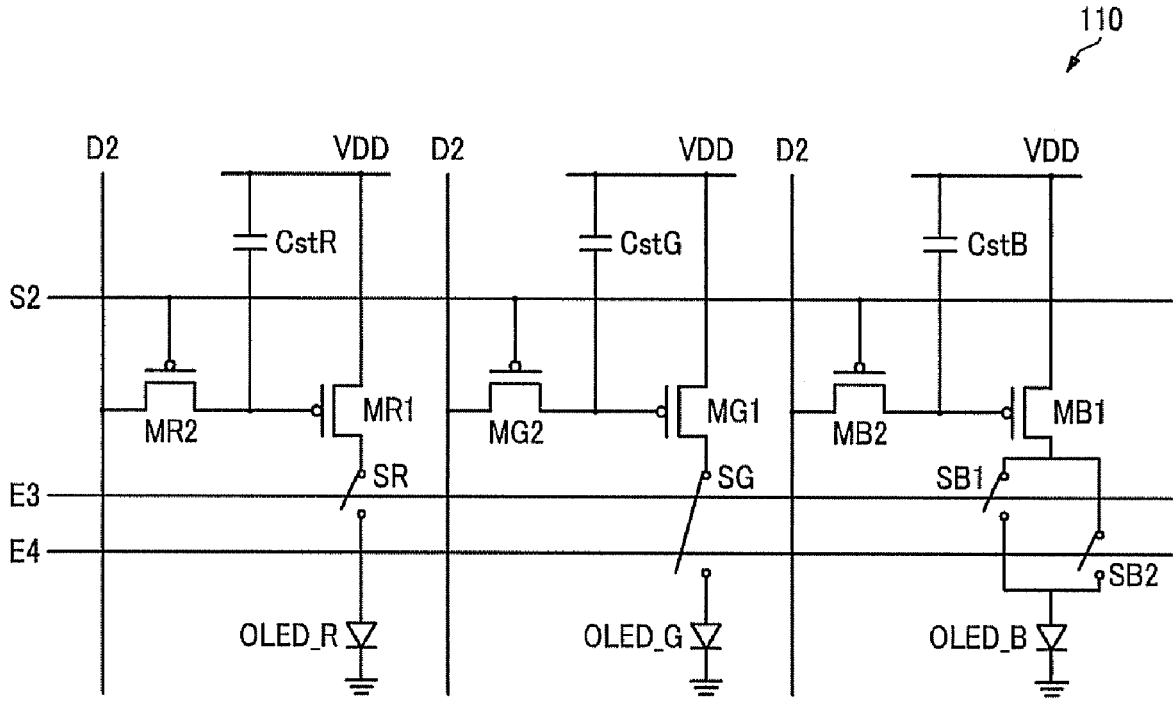
FIG. 2 is a diagram of a pixel circuit according to an embodiment of the present invention.

FIG. 2 is a diagram of a pixel circuit according to an embodiment of the present invention.

As shown in FIG. 2, the pixel 110 includes three subpixels: the R subpixel, the G subpixel, and the B subpixel. The R subpixel includes a driving transistor MR1, a switching transistor MR2, a storage capacitor CstR, a light emission control switch SR, and an organic electroluminescent element OLED_R. The G subpixel includes a driving transistor MG1, a switching transistor MG2, a storage capacitor CstG, a light emission control switch SG, and an organic electroluminescent element OLED_G. And, the B subpixel includes a driving transistor MB1, a switching transistor MB2, a storage capacitor CstB, light emission control switches SB1 and SB2, and an organic electroluminescent element OLED_B. The B subpixel includes two light emission control switches SB1 and SB2. The transistors MR1, MR2, MG1, MG2, MB1, and MB2 are p-channel metal-oxide semiconductor (PMOS) transistors. Each of the transistors MR1, MR2, MG1, MG2, MB1, and MB2 has a source electrode, a drain electrode, and a gate electrode. The gate electrodes of the transistors MR1, MR2, MG1, MG2, MB1, and MB2 are control electrodes.

Each of the R, G, and B subpixels is connected to the same scan line S1-Sn and connected to the same data line D1-Dm. As illustrated here, the R, G, and B subpixels are connected to the scan line S2 and the data line D2 and are arranged in the row direction. Furthermore, each of the R, G, and B subpixels is connected to at least one of the light emission control lines E1-E2*n*. As specifically illustrated here, the R subpixel is connected to the light emission control line E3, the G subpixel is connected to the light emission control lines E3 and E4, and the B subpixel is connected to the light emission control lines E3 and E4. And, each of the R, G, and B subpixels is connected to a power source supplying a driving voltage VDD.

In the R subpixel, the transistor MR1 is a driving transistor to drive the organic electroluminescent element OLED_R. The transistor MR1 is connected between a power source, which supplies a voltage VDD to the circuit, and the organic electroluminescent element OLED_R, which emits light when a voltage potential is applied thereto. The transistor MR1 is controlled by a voltage applied to the gate electrode of the transistor MR1, which thereby controls a current flowing to the organic electroluminescent element OLED_R. The gate electrode of the transistor MR1 is connected to an electrode A1 of the capacitor CstR and the drain electrode of the switching transistor MR2. The source electrode of the transistor MR1 is connected to the other electrode B1 of the capacitor CstR and the power source that supplies the voltage VDD.

The source electrode of the transistor MR2 is connected to a data line D2. The drain electrode of the transistor MR2 is connected to the electrode A1 of the capacitor CstR and the gate electrode of the driving transistor MR1. And, the gate electrode of the transistor MR2 is connected to a scan line S2. The transistor MR2 transfers a data signal from the data line D2 to the electrode A1 of the capacitor CstR in response to a selection signal from the scan line S2. The transistor MR1 is turned on by a voltage difference between the gate and the source electrode of transistor MR1, and then a current corresponding to the gate-source voltage difference flows to the drain electrode while the capacitor CstR maintains and stores the voltage difference. The light emission control switch SR is connected to a light emission control line E3 to be controlled by a light emission control signal from the light emission controller 400 via the light emission control line E3. When the light emission control switch SR is turned on, the current flowing through the drain electrode of the transistor MR1 is supplied to the organic electroluminescent element OLED_R, causing the organic electroluminescent element OLED_R to emit light. The organic electroluminescent element OLED_R emits light in response to the data received from the data line D2.

The G and B subpixels have similar structures to the R subpixel except for the arrangement of the light emission control switches and the connections to the light emission control lines E3 and E4.

The light emission control switch SG of the G subpixel is connected to the light emission control lines E3 and E4, and the light emission control switch SG is controlled by two light emission control signals from the light emission controller 400 via the light emission control lines E3 and E4. When the light emission control switch SG is turned on by the light emission control signal, the current flowing through the drain electrode of the transistor MG1 is transferred to the organic electroluminescent element OLED_G, causing the organic electroluminescent element OLED_G to emit light. The light emission control switch SG of the G subpixel may be a transistor having a dual gate electrode structure, and the light emission control switch SG may be turned on when two light emission control signals have a predetermined level. For example, if the light emission control switch SG is a transistor having a p-channel type dual gate electrode structure, the two light emission control signals transferred to the dual gate electrode necessary to turn on the light emission control switch SG will have a low level. However, if the light emission control switch SG is a transistor having an n-channel type dual gate structure, the two light emission control signals transferred to the dual gate electrode necessary to turn on the light emission control switch SG will have a high level. Although the light emission control switch SG has been described to be controlled by two light emission control signals, it is not limited thereto. The light emission control switch SG may be controlled by at least one of the two light emission control signals from the light emission control lines E3 and E4. For example, the light emission control switch SG may be a PMOS transistor that is controlled by the light emission control signal from the light emission control line E3, and the transistor is turned on when the light emission control signal has a low level.

The light emission control switch SB of the B subpixel is connected to the light emission control lines E3 and E4, and the light emission control switch SB is controlled by the light emission control signals from the light emission controller 400 via one of the light emission control lines E3 and E4. When the light emission control switch SB1 or SB2 is turned on by the light emission control signal, the current flowing through the drain electrode of the transistor MB1 is supplied to the organic electroluminescent element OLED_B, causing the organic electroluminescent element OLED_B to emit light.

The driving operation of the device will now be described with reference to FIG. 3.

Figure 3:
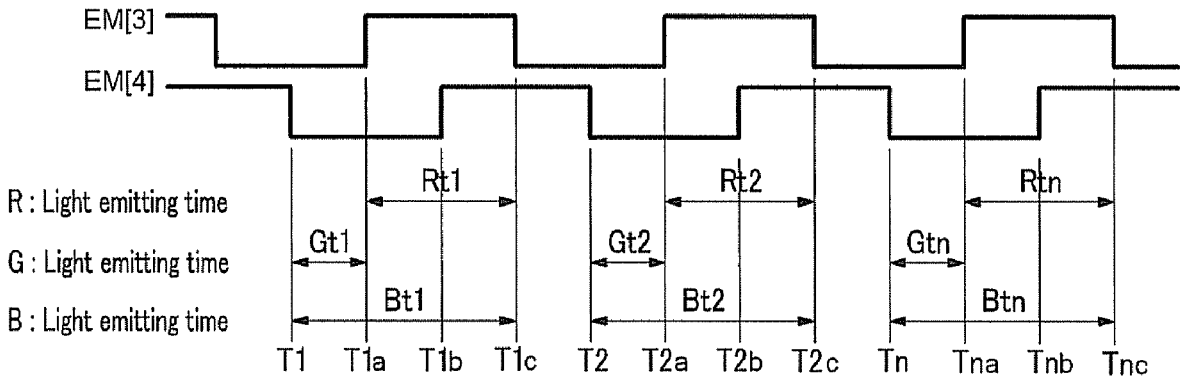
FIG. 3 is a diagram of light emission control signals according to an embodiment of the present invention.

FIG. 3 is a diagram showing light emission control signals and the responses of the organic electroluminescent elements OLED_R, OLED_G, and OLED_B.

As shown in FIG. 3, a light emission control signal EM[3] and a light emission control signal EM[4] from the light emission control line E3 and the light emission control line E4, respectively, are signals cycling through a high level and a low level. The light emission control switch SR of the R subpixel within the pixel 110 circuit is turned on in response to a high level of the light emission control signal EM[3]. The light emission control switch SG of the G subpixel is turned on when both of the two light emission control signals EM[3] and EM[4] are at a low level. The light emission control switch SB1 of the B subpixel is turned on in response to a high level of the light emission control signal EM[3], and also, the light emission control switch SB2 is turned on in response to a low level of the light emission control signal EM[4]. When either of the two light emission control switches SB1 and SB2 is turned on by the light emission control signals EM[3] and EM[4], the organic electroluminescent element OLED_B receives current and emits light.

Before the light emission control signals EM[3] and EM[4] are transferred to each light emission control switch SR, SG, SB1 and SB2, each driving transistor MR1, MG1, and MB1 is turned on, and each capacitor CstR, CstG, and CstB is charged with a voltage corresponding to a data signal received from the data driver 300 via the corresponding data line D1-Dm.

In an interval of time T1 to time T1*a*, both of the light emission control signals EM[3] and EM[4] are at a low level. As such, the light emission control switch SG of the G subpixel is turned on resulting in the transfer of the current flowing through the drain electrode of the driving transistor MG1 to the organic electroluminescent element OLED_G. When the organic electroluminescent element OLED_G receives the current, the organic electroluminescent element OLED_G emits light. Also in the interval time T1 to time T1*a*, the light emission control switch SB2 is turned on as the light emission control signal EM[4] is at a low level. Thus, the current flowing from the data line D2 through the drain electrode of the driving transistor MB1 is transferred to the organic electroluminescent element OLED_B, causing the organic electroluminescent element OLED_B to emit light.

Moving to an interval of time T1*a* to time T1*b*, the light emission control signal EM[4] remains at a low level, but the light emission control signal EM[3] switches to a high level. As such, the light emission control switch SG of the G subpixel is turned off, and the organic electroluminescent element OLED_G stops emitting light. The light emission control switch SB2 remains turned on as the light emission control signal EM[4] remains at a low level. Also, the light emission control switch SB1 of the B subpixel turns on as the light emission control signal EM[3] switches from a low to a high level. The light emission control switch SR of the R subpixel switches from turned off to turned on as the light emission control signal EM[3] switches form a low to a high level. In the internal of time T1*a* to time T1*b*, light emission control switches SR, SB1, and SB2 are turned on, and the light emission control switch SG is turned off. Thus, from T1*a* to T1*b*, the R subpixel and the B subpixel are both emitting light while the G subpixel is not emitting light.

During an interval of time T1*b* to time T1*c*, the light emission control signal EM[3] remains at a high level while the light emission control signal EM[4] switches from a low level to a high level. The light emission control switch SR of the R subpixel remains turned on because the light emission control switch is only dependent upon the light emission control signal EM[3]. The light emission control switch SG of the G subpixel remains turned off because the light emission control switch is dependent upon both of the light emission control signals EM[3] and EM[4]. And, as both of the light emission control signals EM[3] and EM[4] are not at the low level, the light emission control switch SG remains turned off. The B subpixel continues to emit light even though the light emission control signal EM[4] switched from low to high because the light emission control signal EM[3] remains at the high level resulting in the light emission control switch SB1 remaining turned on. The B subpixel emits light when the light emission control signal EM[3] is high or when the light emission control signal EM[4] is low.

At time T1*c*, the light emission control signal EM[3] switches to a low level while the light emission control signal EM[4] remains at a high level. As this configuration results in none of the light emission control switches SR, SG, SB1, or SB2 being turned on, none of the organic electroluminescent elements OLED_R, OLED_G, or OLED_B emit light during an interval of time T1*c* to T2.

In summary, the organic electroluminescent element OLED_G emits light as the light emission control switch SG is turned on when both of the light emission control signals EM[3] and EM[4] are at a low level. As depicted in FIG. 3, the organic electroluminescent element OLED_G will emit light over the interval of time T1 to time T1*a* for a time Gt1. The organic electroluminescent element OLED_R emits light as the light emission control switch SR is turned on when the light emission control signal EM[3] is at a high level independent of the light emission control signal EM[4]. So, the organic electroluminescent element OLED_R will emit light over the interval of time T1*a* to time T1*c* for a time Rt1. The organic electroluminescent element OLED_B emits light when the light emission control switch SB1 or the light emission control switch SB2 is turned on. The light emission control switch SB1 is turned on when the light emission control signal EM[3] is high, and the light emission control switch SB2 is turned on when the light emission control signal EM[4] is low. So, the organic electroluminescent element OLED_B will emit light over the interval of time T1 to time T1*c* for time Bt1.

As the light emission control signals EM[3] and EM[4] cycle from T1 to T2 to Tn, the organic electroluminescent element OLED_R, OLED_G, and OLED_B will continue to repeat the same pattern of light emission. The light emission pattern established by the cycling of the light emission control signals EM[3] and EM[4] in FIG. 3 is illustrative of the possible control over the light emission of the organic electroluminescent elements OLED_R, OLED_G, and OLED_B established by only two light emission control lines connected to the three R, G, and B subpixels.

The OLED display device can vary a driving current through the driving transistors and represent a same grayscale corresponding to a same data signal even though the light emitting time of each R, G, and B subpixel differs. More specifically, the OLED display device can generate a different driving current for the same data voltage to provide to each subpixel by varying the channel width and length of the corresponding driving transistors.

By repeating such an operation, each of the R, G, and B subpixels has a different light emitting time, and the light emitting time of the three subpixels can be determined by two light emission control signals. Moreover, since a plurality of pixels in adjacent rows can share a light emission control signal, the light emitting time of the two pixels can be controlled by only two light emission control signals as opposed to the 6 light emission control signals required of the related art; or, only ⅓ times the number of light emission control signals are needed compared to the related art. Therefore, the number of light emission control lines can be reduced.

The present invention is not limited to the aforementioned embodiments and at least provides an OLED display device and a method to drive the same that can change the light emitting time of each of the R, G, and B subpixels to drive the display.

According to aspects of the present invention, an organic electroluminescent display device and the driving method thereof that can reduce the number of light emission control lines and the area of drivers and increase the area of pixels are provided.

Therefore, an organic electroluminescent display device and the driving method thereof in which the aperture ratio can improve are provided.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An organic electroluminescent display device, comprising:

a first organic electroluminescent element;

a second organic electroluminescent element;

a third organic electroluminescent element;

a first driving transistor to apply a first driving current to the first electroluminescent element;

a second driving transistor to apply a second driving current to the second electroluminescent element;

a third driving transistor to apply a third driving current to the third electroluminescent element;

a first switch connected between a first electrode of the first organic electroluminescent element and a first electrode of the first driving transistor;

a second switch connected between a first electrode of the second organic electroluminescent element and a first electrode of the second driving transistor;

a third switch group connected between a first electrode of the third organic electroluminescent element and a first electrode of the third driving transistor;

a first light emission control line to transfer a first light emission control signal; and a second light emission control line to transfer a second light emission control signal, wherein the first switch is turned on/off in response to the first light emission control signal, the second switch is turned on/off in response to at least one of the first and second light emission control signals, and the third switch group is turned on/off in response to the first and second light emission control signals.

2. The organic electroluminescent display device of claim 1, wherein the third switch group comprises:

a third switch turned on/off in response to the first light emission control signal; and a fourth switch turned on/off in response to the second light emission control signal.

3. The organic electroluminescent display device of claim 2, wherein:

the third switch is connected between the first electrode of the third organic electroluminescent element and the first electrode of the third driving transistor; and the fourth switch is connected between the first electrode of the third organic electroluminescent element and the first electrode of the third driving transistor.

4. The organic electroluminescent display device of claim 3, wherein:

the first switch is turned on when the first light emission control signal is at a first level;

the second switch is turned on when both the first and the second light emission control signals are at a second level;

the third switch is turned on when the first light emission control signal is at the first level; and the fourth switch is turned on when the second light emission control signal is at the second level.

5. The organic electroluminescent display device of claim 4, wherein the first, second, and third organic electroluminescent elements correspond to first, second, and third color subpixels, respectively.

6. The organic electroluminescent display device of claim 1, wherein channel lengths and/or channel widths of the first, second, and third driving transistors vary to generate the first, second, and third driving current, respectively.

7. A method for driving an organic electroluminescent display device that applies first, second, and third driving currents transferred from first, second, and third driving transistors, respectively, the method comprising:

a first operation of applying the first driving current to a first subpixel corresponding to the first driving transistor during a first period;

a second operation of applying the second driving current to a second subpixel corresponding to the second driving transistor during a second period; and a third operation of applying the third driving current to a third subpixel corresponding to the third driving transistor during a third period, wherein the third period overlaps the first period and the second period, and wherein the first, second, and third driving currents are applied in response to a first control signal and a second control signal.

8. The method of claim 7, wherein the third period of the third operation comprises:

a period of applying the third driving current in response to the first control signal;

a period of applying the third driving current in response to the first control signal and the second control signal; and a period of applying the third driving current in response to the second control signal.

9. The method of claim 8, wherein the sum of the first and second periods is equal to the third period.

10. An organic electroluminescent display, comprising:

a plurality of pixels wherein each pixel comprises a first, second, and third electroluminescent element;

a scan driver to transfer a selection signal to a pixel of the plurality of pixels;

a data driver to transfer a data signal to the pixel;

a light emission controller to control a light emitting time of the first, second, and third electroluminescent elements of the pixel; and a power source to supply a driving current to the plurality of pixels, wherein the light emission controller controls the light emitting time of the first, second, and third electroluminescent elements with a first light emission control signal and a second light emission control signal.

11. The organic electroluminescent display of claim 10, wherein:

the light emission controller supplies the first light emission control signal through a first light emission control line, and the light emission controller supplies the second light emission control signal through a second light emission control line.

12. The organic electroluminescent display of claim 11, wherein:

the light emission controller supplies the first light emission control signal to the first, second, and third electroluminescent elements through the first light emission control line, and the light emission controller supplies the second light emission control signal to the second and third electroluminescent elements through the second light emission control line.

13. The organic electroluminescent display of claim 10, wherein the first electroluminescent element emits light in response to the first light emission control signal;

the second electroluminescent element emits light in response to at least one the first and second light emission control signals;

the third electroluminescent element emits light in response to both the first and the second light emission control signal.

14. The organic electroluminescent display of claim 10, wherein the first electroluminescent element emits light when the first light emission control signal is at a first level;

the second electroluminescent element emits light when the first and second light emission control signals are both at a second level;

the third electroluminescent element emits light when the first light emission control signal is at the first level; and the third electroluminescent element emits light when the second light emission control signal is at the second level.

15. A method for driving an organic electroluminescent display having a plurality of pixels arranged in rows, wherein each pixel comprises a first, a second, and a third electroluminescent element, the method comprising:

selecting a first row of pixels through a scan line;

applying a data signal to a first pixel in the first row of pixels;

emitting light from the first, second, and third electroluminescent elements of the first pixel in the first row of pixels in response to a first light emission control signal and a second light emission control signal applied to the first, second, and third electroluminescent elements of the first pixel in the first row of pixels.

16. The method of claim 15, further comprising:

emitting light from the first electroluminescent element in response to the first light emission control signal, emitting light from the second electroluminescent element in response to at least one of the first and the second light emission control signals, and emitting light from the third electroluminescent element in response to the first and the second light emission control signals.

17. The method of claim 15, further comprising:

upon completing applying a data signal to at least the first pixel in the first row of pixels, selecting a second row of pixels through a second scan line;

applying a data signal to a first pixel in the second row of pixels; and emitting light from the first, second, and third electroluminescent elements of the first pixel in the second row of pixels by applying a third and a fourth light emission control signal to the first pixel in the second row of pixels.

18. The method of claim 15, wherein the applying of the data signal comprises:

generating a first, a second, and a third driving current for the data signal, and applying the first, second, and third driving currents to the first, second, and third electroluminescent elements, respectively.

19. A method of driving an organic electroluminescent display having a plurality of pixels arranged in rows, wherein each pixel comprises a first, a second, and a third electroluminescent element, the method comprising:

selecting a first row of pixels through a scan line;

applying a data signal to a first pixel in the first row of pixels emitting light from the first, second, and third electroluminescent elements of the first pixel in the first row of pixels by applying a first and a second light emission control signal to the first pixel in the first row of pixels.

wherein the applying of the data signal comprises:

generating a first, a second, and a third driving current for the data signal, and applying the first, second, and third driving currents to the first, second, and third electroluminescent elements, respectively, and wherein the generating of the first, second, and third driving currents comprises:

varying channel widths and/or channel lengths of a first, a second, and a third driving transistor to generate the first, second, and third driving currents, respectively.

* * * * *